US005215250A

United States Patent [19]

Roccaforte

[11] Patent Number: 5,215,250

[45] Date of Patent: Jun. 1, 1993

[54] CARTON WITH IMPROVED POURING SPOUT

[75] Inventor: Harry I. Roccaforte, Chicago, Ill.

[73] Assignee: Waldorf Corporation, St. Paul, Minn.

[21] Appl. No.: 839,359

[22] Filed: Feb. 20, 1992

[51] Int. Cl.[5] ..... B65D 5/74

[52] U.S. Cl. ..... 229/215; 229/221

[58] Field of Search ..... 229/214, 215, 221, 217, 229/219

[56] References Cited

U.S. PATENT DOCUMENTS

| | | | |
|---|---|---|---|
| 1,539,985 | 6/1925 | Allen . | |
| 1,907,939 | 5/1933 | Venning et al. | 229/215 |
| 2,019,943 | 11/1935 | Venning et al. | 229/217 |
| 2,742,220 | 4/1956 | Lynes . | |
| 2,760,708 | 8/1956 | Phillips | 229/215 |
| 2,989,224 | 6/1961 | Umanoff | 229/217 |
| 3,096,011 | 7/1963 | Davis . | |
| 3,184,137 | 5/1965 | Mohler | 229/215 |
| 3,344,972 | 10/1967 | Robinson et al. . | |
| 3,568,910 | 3/1971 | McConnell . | |
| 3,831,833 | 8/1974 | Dressler et al. . | |
| 4,054,240 | 10/1977 | LaPierre . | |
| 4,150,778 | 4/1979 | Engdahl, Jr. | 229/215 |
| 4,168,003 | 9/1979 | Wysocki | 229/217 |
| 4,194,677 | 3/1980 | Wysocki . | |
| 4,569,443 | 2/1986 | Roccaforte | 206/807 |

*Primary Examiner*—Gary E. Elkins
*Attorney, Agent, or Firm*—Dorsey & Whitney

[57] ABSTRACT

A carton with integral pouring spout is provided. The carton includes first and second side wall panels, first and second end wall panels hingedly connected to the first and second side wall panels, and top and bottom closure panels attached to the side wall panels to form a tubular carton having a rectangular cross-section. The integral pouring spout is formed in one of the wall panels of the carton by cooperating interior and exterior pouring spout components. The spout is adapted for cartons having a narrow width or thickness by having a split exterior spout component including an automatic supplemental side wing. The invention encompasses a single-piece flat blank for forming the carton and spout, including a removable access tab located immediately adjacent the spout to prevent unwanted opening.

16 Claims, 6 Drawing Sheets

CARTON WITH IMPROVED POURING SPOUT

CARTON WITH IMPROVED POURING SPOUT

The present invention relates to paperboard cartons with integral pouring spouts. More particularly, it relates to the pouring spouts for such cartons, wherein the spout is adapted for use with cartons having a relatively small or narrow width or thickness.

BACKGROUND OF THE INVENTION

Numerous cartons with pouring structures are known, but none has been entirely satisfactory. For example, the spouts disclosed in U.S. Pat. Nos. 3,344,972 (to Robinson et al.), 4,054,240 (to LaPierre) and 4,194,677 (to Wysocki) require stripped out areas that may be difficult and expensive to form (LaPierre and Wysocki), overlying ears (Robinson et al.), and, in each case, large spout-forming bilateral ears or wing members. The latter requirement precludes the satisfactory application of the teachings of these patents to an optimum range of cartons, particularly those having a relatively small width or thickness.

U.S. Pat. Nos. 3,096,011 (to Davis) and 3,568,910 (to McConnell) disclose cartons with pouring spouts wherein the wings or spout sidewall-forming portions, respectively, are outside the carton where they may interfere with the reclosing of the spout (Davis). Additionally, the wings are quite small or narrow, thereby failing to form a complete spout having full sidewalls when the spout is opened fully.

U.S. Pat. No. 4,569,443 (to Roccaforte) solves some of the aforementioned problems, but still requires large spout side-forming wings, thereby precluding its useful application to an optimally wide range of cartons, particularly those for containing and dispensing powdered or granular food items which frequently need to be made available in smaller sizes. In such cartons, it has not been possible to provide a gluing area for the carton, full side-forming wings, and an area that defines the desired width of the spout itself within the constraints imposed by the carton.

Accordingly, there is a need for an integral pouring spout design that is simple, economical, durable, yet easy to open and close, that provides a spout with full sidewalls, and that can be used with a wide range of cartons.

SUMMARY OF THE INVENTION

The present invention overcomes the problems unaddressed by the prior art and provides cartons with a fully-formed integral pouring spout with complete sidewalls, whereby the cartons can be produced in a rapid, efficient, and economical manner and further, whereby the carton provides evidence of tampering.

Briefly and broadly stated, the present invention comprises a carton with an integral pouring spout. The carton comprises first and second side wall panels, first and second end wall panels hingedly connected to the first and second side wall panels, and top and bottom seal-end closure flaps to form a tubular carton having a generally rectangular cross-section. One of the wall panels of the erected carton comprises overlaid inner and outer panel layers having a dispensing opening with a pouring spout formed therethrough. The spout is movable from a closed to an open position, and an access tab is located above and immediately adjacent to the spout. The access tab is removably attached to the outer panel and pouring spout to prevent unwanted opening of the spout. The invention also encompasses a single-piece blank for forming the carton.

It is an object of the present invention to provide a paperboard carton, formed from a single-piece blank, having an integral pouring spout.

Another object of the present invention is to provide a carton having an integral pouring spout wherein the spout has full spout-forming wings or sidewalls when deployed to its open, dispensing position.

An important advantage of the pouring spout of the present invention is that it may be used with a wide range of cartons, including those that have a relatively small width or thickness, to provide a full, complete spout with full spout sidewalls and a spout opening adapted to the carton contents, the size of the carton, and the desired rate of dispensing.

A feature of the present invention is a split or truncated external pouring spout component including an automatically deployable, generally triangular supplementary spout sidewall-forming wing for cooperating with an interior spout forming component to form a pouring spout having sidewalls extending for substantially the entire vertical height from the bottom to the top of the opening of the spout when the spout is in its open, dispensing position.

These and other objects and advantages of the present invention will become more fully apparent and understood with reference to the following specification, and to the appended drawings and claims.

DESCRIPTION OF THE PREFERRED EMBODIMENT

Figure 1:
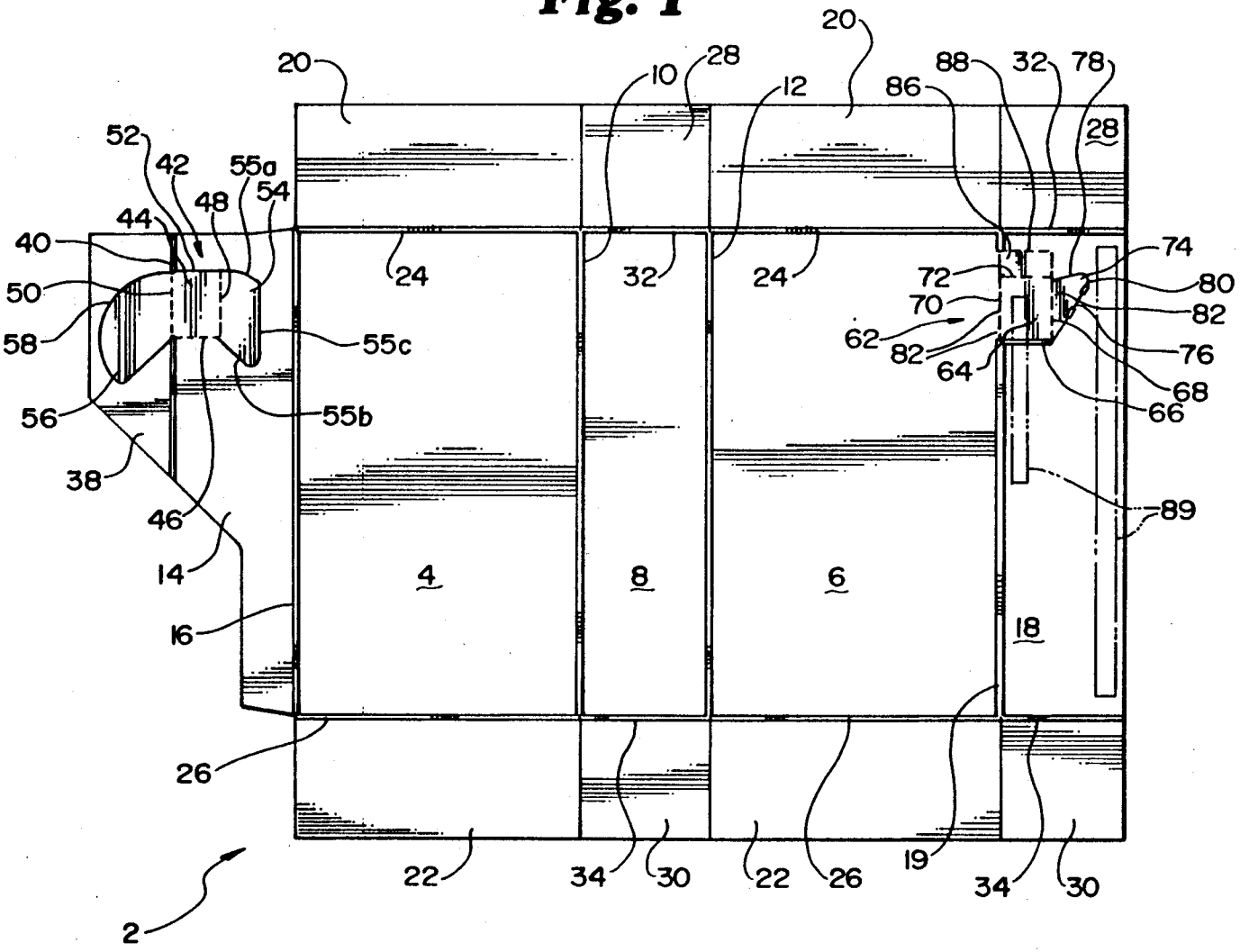
FIG. 1 is a plan view of the blank from which the carton of the present invention may be formed and shows the die-cut profile thereof, including the die-cut profile of the integral pouring spout.

FIG. 1 depicts a flat, single-piece paparboard blank 2 for forming a pouring spout carton in accordance with the present invention. The blank 2 may be formed from conventional paperboard or boxboard of any desired caliper, and is die-cut and scored as depicted by well-known, conventional methods. In the Figs., double lines indicate fold lines and single solid or dashed lines indicate cuts, scores, or free edges.

The blank 2 is cut and scored to define first and second main rectangular side wall panels 4, 6, respectively, a first end wall panel 8 between and hingedly connected to the side wall panels 4, 6 at parallel fold lines 10, 12, respectively, a glue flap 14 hingedly connected to the remaining edge of the first side wall panel 4 at a fold line 16, and a second end wall panel 18 hingedly connected at a fold line 19 to the remaining edge of the second side wall panel 6. Major top and bottom closure flap panels 20, 22, respectively, are hingedly attached to the side walls 4, 6 at fold lines 24, 26, respectively. Minor top and bottom closure flap panels 28, 30, respectively, are hingedly attached to the end walls 8, 18 at fold lines 32, 34, respectively. The fold lines 24, 32 and 26, 34, at the top and bottom, respectively, are generally colinear and perpendicular to the fold lines 10, 12, 16, 19 at the side edges of the main side and end wall panels. Thus, the blank 2 will form a generally tubular carton of rectangular cross-section with closed ends when foldably erected.

A glue flap extension panel 38 is hingedly connected to the glue flap at a fold line 40. An interior pouring spout component, indicated generally at 42, is formed in part in the glue flap 14 and in part in the extension 38. The interior or inside spout component 42 includes a generally rectangular center part 44 with a base 46, parallel sides 48, 50, and a top edge 52. One of the side edges, the edge 50, lies along the hinter or fold line 40 between the glue flap 14 and the extension 38. The center part 44 is hingedly connected at its base 46 to the glue flap 14. A first, generally rectangular, small spout side wall or wing 54 is hingedly attached to one side 48 of the center part 44 and extends generally laterally away therefrom. The small wing 54 has arcuate upper and lower edges 55*a*, 55*b* and a side edge 55*c* parallel to the side edge 48. A second, larger spout side wall or wing 56 is hingedly attached to the other side 50 of the center part 44, extending generally laterally away therefrom. The larger spout wing 56 is generally in the shape of a quarter circle whose unbroken arc may extend 90° from the vertical. The small wing 54 is formed entirely in the glue flap 14, and the relatively larger wing 56 is formed entirely in the glue flap extension 38. Both wings 54, 56 are formed by a single continuous cut line 58 extending from the ends of the base 46, or base corners of the center part 44, and continuous with the top edge 52 of the center part 44. With this arrangement of the internal pouring spout component 42, no scrap has to be removed from the glue flap 14 or the extension 38, thus providing, in the blank 2, a continuous surface about the internal pouring spout component 42 and giving better control, speed and efficiency in the gluing process at the time the blank 2 is being processed.

With continued reference to FIG. 1, the blank 2 includes an external or exterior pouring spout component, indicated generally at 62, formed within the second end wall 18 adjacent the upper or top edge thereof. The exterior pouring spout component 62 is split into two portions, including a generally rectangular exterior pouring spout tab 64 having a base 66, two parallel sides 68, 70, and a top edge 72. One of the side edges 70 of the tab 64 lies along the line of articulation or hinge 19 between the side wall 6 and the end wall 18. The tab 64 is hingedly connected at its base 66 to the side wall 18.

The split spout component 62 further includes a generally right-triangularly shaped exterior supplemental wing 74. The exterior wing 74 and the tab 64 are immediately adjacent, having one common side edge 68 formed by a single continuous cut or incision. The wing 74 is hingedly connected to the end wall 18 along its hypotenuse edge at a perforated fold score line 76. The remaining, uppermost edge of the wing 74 is defined by a single cut line 78 that is substantially continuous with the top edge 72 of the tab 64. The line 78 is substantially colinear with the tab edge 72, but, as depicted in FIG. 1, may angle slightly upwardly from the intersection of edge 72 and line 78 to the rounded or radiused ring corner 80 at the intersection of the hinge line 76 and the cut line 78. The exterior spout component 62 is held in place in the place of the side wall 18 by slight interruptions or nicks 82 in the line of cut defining the side edges 68, 70 of the tab 64.

A removable access tab 86 is located above and immediately adjacent the exterior pouring spout tab 64. The access tab 86 is removably attached to the end wall 18 and to the pouring spout tab to prevent opening of the pouring spout until the access tab 86 is removed. The tab 86 is held in place by uncut paperboard between perforations 88, easily torn to allow the tab 86 to be removed. The access tab 86 serves at least two purposes: it provides evidence of tampering involving the carton spout and, during production, it eliminates the necessity of stripping out an area immediately above and adjacent to the pouring spout to allow access to the exterior spout component 62 after the carton is formed.

Figure 2:
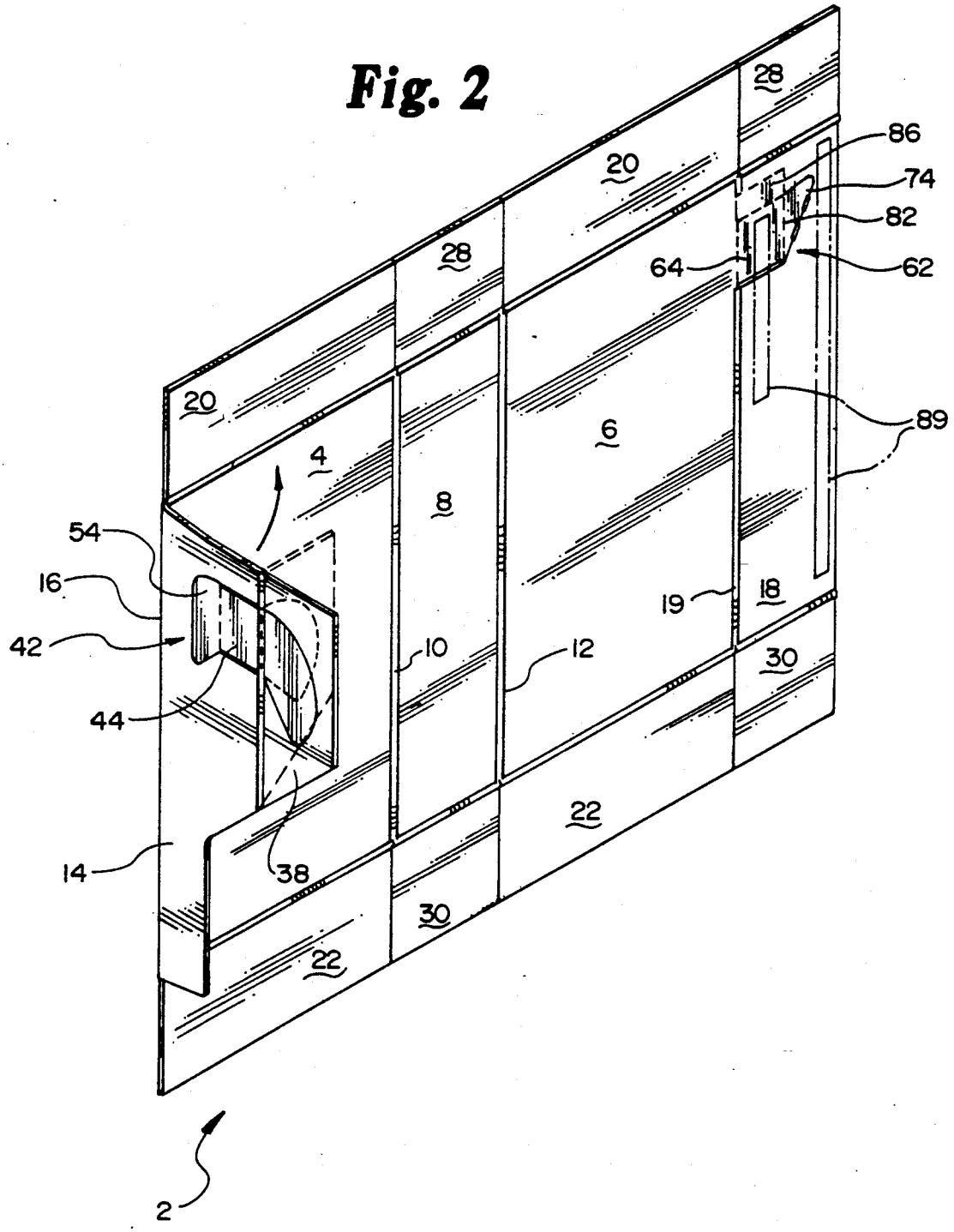
FIG. 2 is a perspective view of an initial step in the formation of the carton of the present invention.
Figure 3:
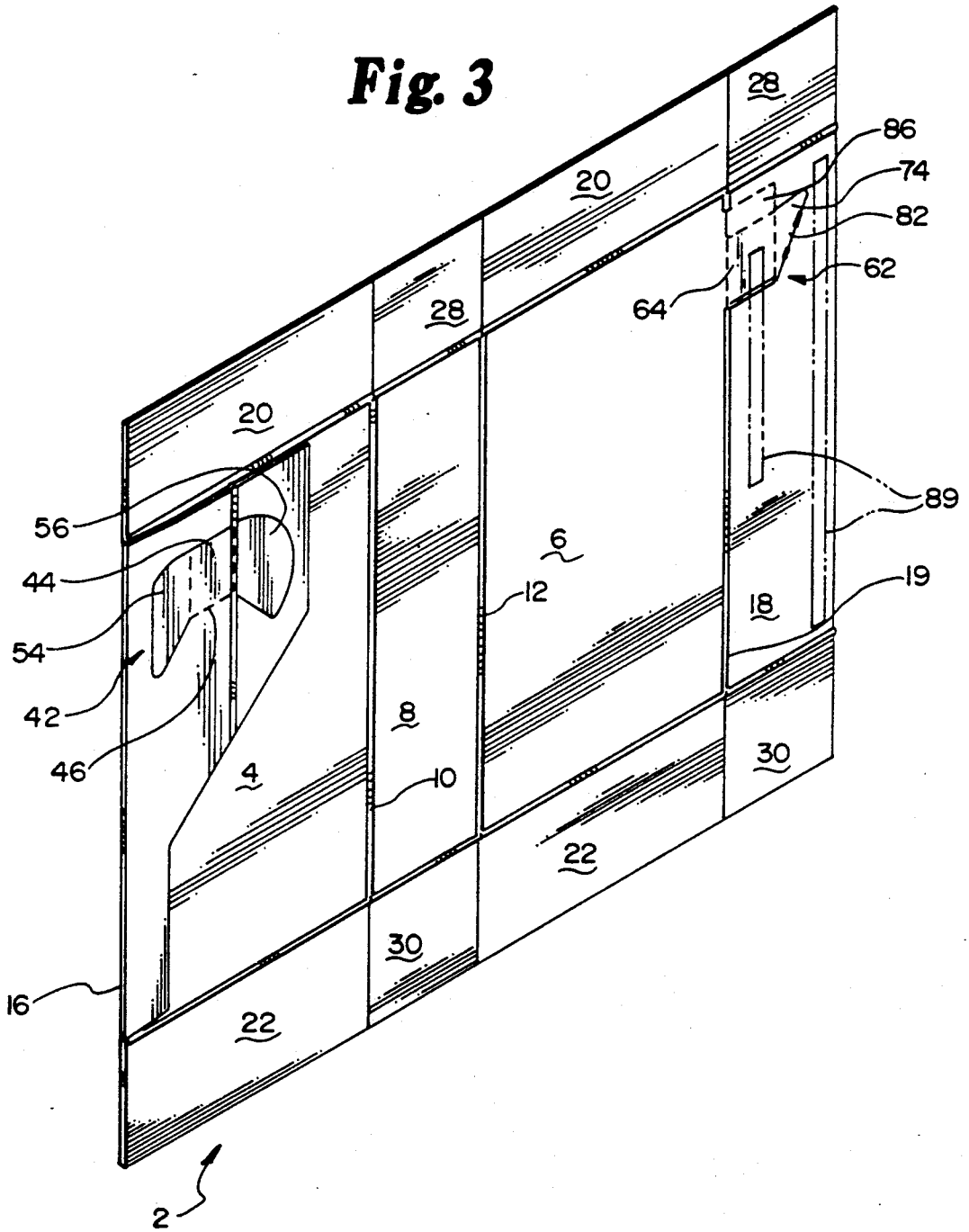
FIG. 3 is a perspective view of a subsequent step in the formation of the carton.

Adhesive or glue areas 89 are depicted in FIGS. 1, 2 and 3. As will be shown hereinafter, when the blank 2 is folded, the exterior pouring spout tab 64 is superimposed above and generally contiguous with central part 44 of the interior pouring spout 42. The upper edge 72 of the tab 64 is slightly offset below the upper edge 52 of the center part 44. It is imperative that the exterior pouring spout tab 64 be glued to center part 44. However, because it is necessary to remove access tab 14 to expose the top edge 72 of the exterior tab 64 for the purpose of inserting the fingernail or other object to open the spout, it is desirable that the access tab 86 not be adhered to the glue flap 18. This can be accomplished as known in the prior art by applying glue only in the areas depicted, or by applying printing ink or varnish in the appropriate location.

Figure 4:
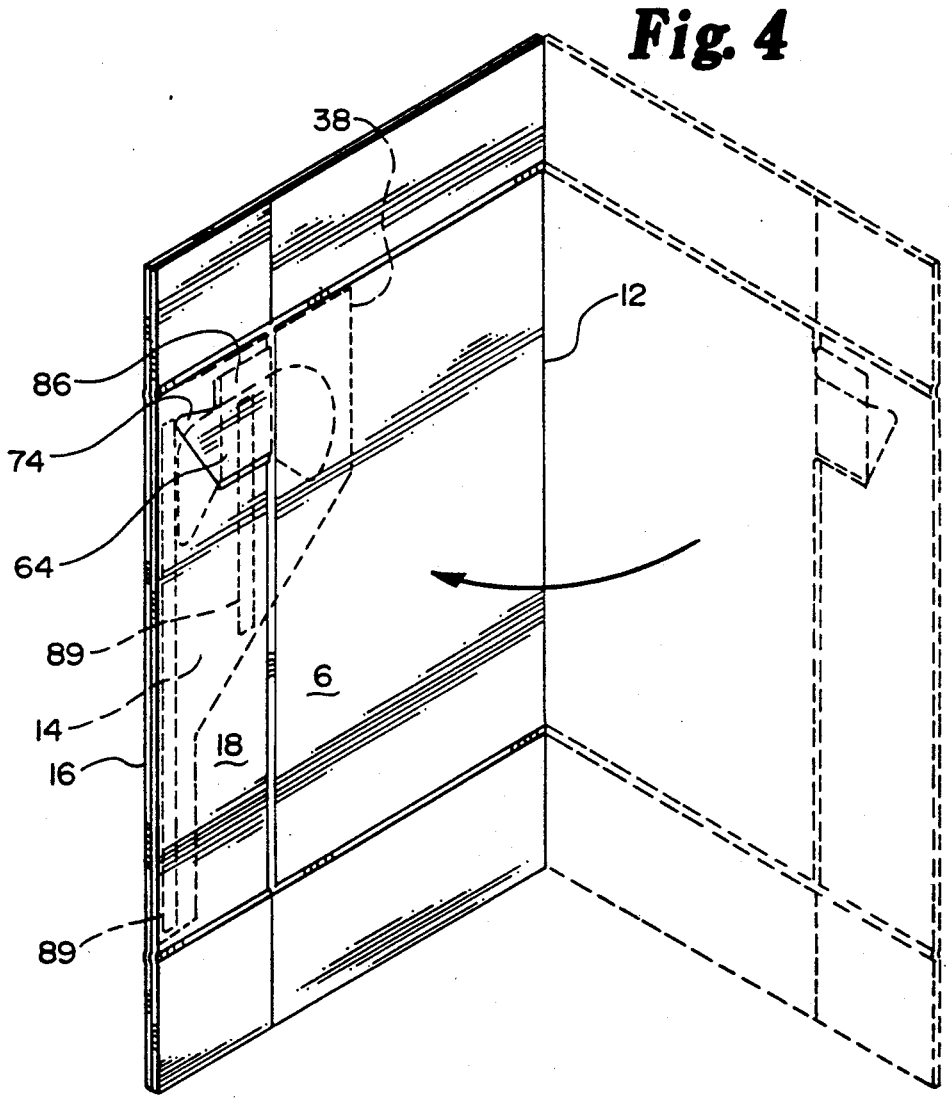
FIG. 4 is a perspective view of yet another step in the formation of the carton.
Figure 5:
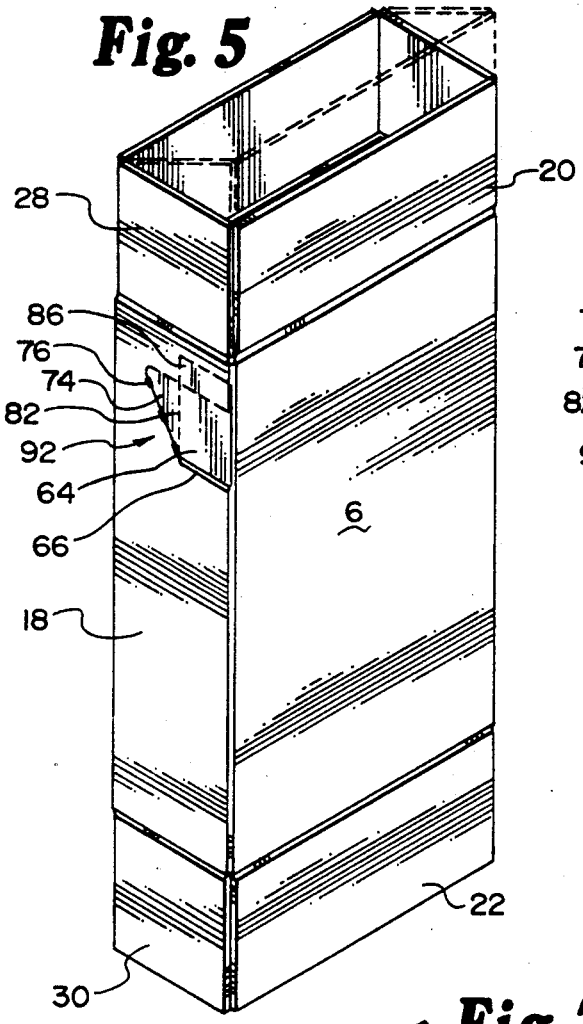
FIG. 5 is a perspective view depicting the carton of the present invention partially erected.
Figure 6:
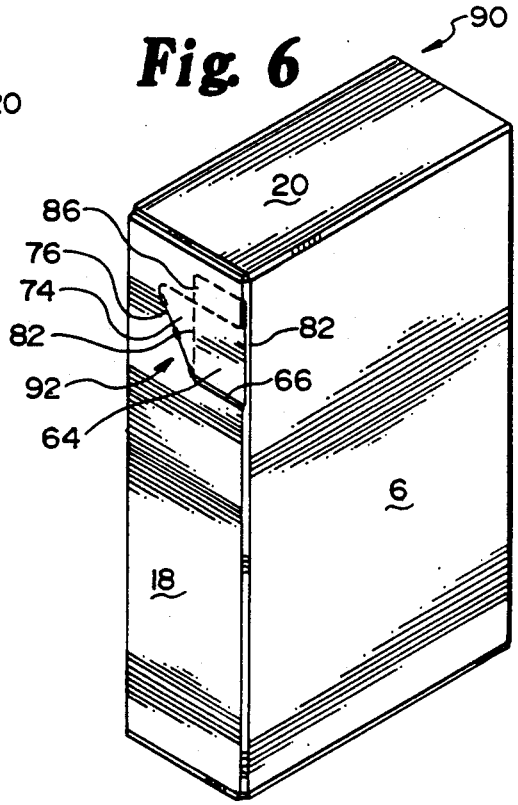
FIG. 6 is a perspective view of the carton fully erected and sealed.

FIGS. 2–5 depict selected steps in the erection or folding of the blank 2 to form the carton 90 of the present invention (depicted fully formed in FIG. 6). As shown in FIG. 2, the glue flap 14 and extension 38 are first folded about the fold line 16 into the close, parallel overlapping relationship with the side wall panel 4 as shown in FIG. 3. Next, as shown in FIG. 4, the blank 2 is folded about the articulation or fold line 12 so that the main side wall panels 4, 6 are in close parallel overlapping relation, and so that the end wall panel 18 contacts the glue flap 14. In this position, the extension 38 is in contact with the second main side wall panel 6. Also, in this overlapped position, the interior pouring spout center part 44 is aligned with, immediately adjacent to, and generally contiguous with the exterior pouring spout tab 64. The blank 2 is held in this position by previously applied glue or other adhesion means in the adhesive areas 89. The easy access tab 86 is closely adjacent the glue flap 14, but is not adhered thereto.

In the state depicted in FIG. 4, the partially folded blank 2 can be shipped to a user who will erect it by "tubing" it, as shown in FIG. 5, then folding inwardly, one after the other, the major and minor top and bottom panels 20, 22, 28, 30, whereby a fully erected, sealed carton 90 of substantially rectangular shape is formed, as depicted in FIG. 6. The dispensing spout, indicated generally at 92, is held closed by the access tab 86 and by the nicks 82.

Figure 7:
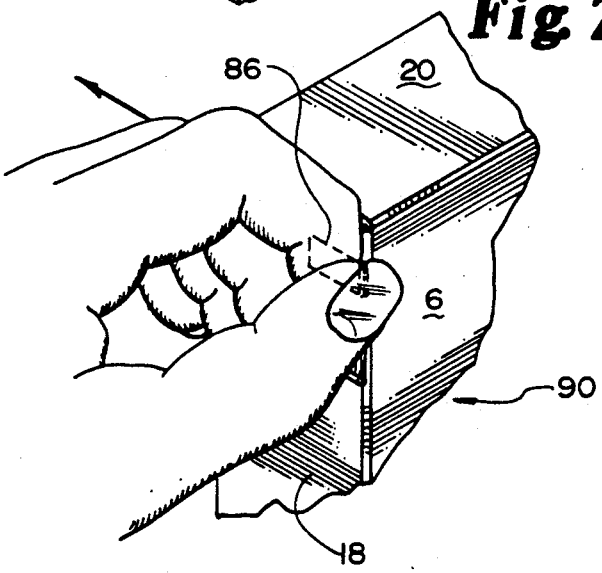
FIG. 7 is a fragmentary perspective view depicting an initial step in opening the carton of the present invention.
Figure 8:
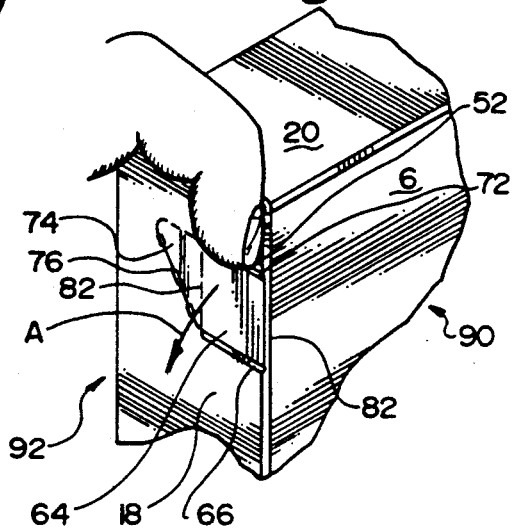
FIG. 8 is a fragmentary perspective view depicting a subsequent step in the opening of the integral pouring spout of the carton of the present invention.

FIGS. 7 and 8 are fragmentary perspective views illustrating the carton 90, particularly the spout 92, being opened. With reference to FIG. 7, the easy access tab 86 may be removed by pulling it away from the end wall 18. The resulting opening exposes the offset top edges 52, 72 of the superimposed interior center part 44 and exterior tab 64 to enable a finger, fingernail, or other object to contact or grasp the top of the spout 92. As depicted in FIG. 8, the top of the spout is pulled outwardly away from the carton 90, causing the spout 92 to pivot about the hinge lines 46, 66. The spout 92 is thus extended to the open position as shown in FIGS. 9 and 10.

Figure 9:
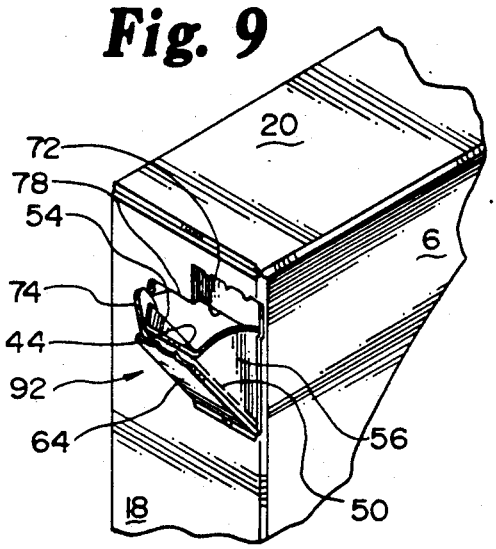
FIG. 9 is a fragmentary perspective view illustrating the carton with its spout in an open position.
Figure 10:
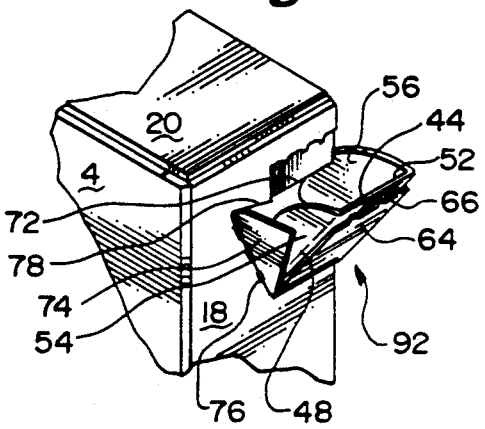
FIG. 10 is a fragmentary perspective view similar to that of FIG. 9.

A distinct advantage of the carton 90 of the present invention can be seen in FIGS. 9 and 10, namely, even though one wing 54 of the interior pour spout component 42 is smaller than the other full size wing 56 to enable a dispensing opening of the desired size, a complete pouring spout 92 is formed, having attached to each side thereof full wings or side walls extending from the bottom to the top of the rectangular opening formed by open pouring spout 92. One full spout side-wall or spout wing is formed by the full size wing 56 and the other is formed by the combined small wing 54 and the external supplemental wing 74. How this advantage is accomplished can be understood by reference to FIGS. 8–10.

In FIG. 8, a force is applied outwardly along arrow A, breaking the nicks 82 and pivoting the top of the spout 92 outwardly from the carton 90. The two interior wings 54, 56 are pivotally moved out of the glue flap 14 and extension 38, respectively, about their associated hinge axis lines 48, 50, following the overlaid center part 44 and exterior tab 64 outwardly. Simultaneously, the exterior, supplemental wing 74 is forced outwardly about its hinge axis 76 by contact with the small interior wing 54. Alone, the small wing 54 would not be adequate to form a complete spout with full height side walls as is advantageous to avoid spilling the carton contents. However, the unique design of the cooperating elements of the present invention, particularly the exterior pouring spout component 62 and its associated, automatically deployable supplemental wing 74, enables the formation of a complete spout 92 of the desired size, even in cartons having a relatively narrow width or thickness.

When a sufficient amount of the carton contents have been dispensed, the user merely pushes (against arrow A of FIG. 8) the front of pouring spout 92 inwardly toward the carton in the direction of the bias created by the inherent resiliency of the paperboard, specifically by the hinge line 76 of the wing 74, and the spout 92 pivots about the base hinge lines 46, 66, returning to its normally closed position and resealing the carton 90. With reference to FIGS. 9 and 10, another advantage of the spout 92 is that the area of the wall 18 immediately above and adjacent to the intersection of the edge 72 and line 78 acts as a stop, cooperating with the center part 44 and the small wing 54 to prevent the spout 92 from being pushed inadvertently into the carton interior, thereby ensuring that the spout can be reopened easily.

A number of variations of the present invention can be made. For example, the size of the carton may be varied, as may the size of the pouring spout. Although a generally rectangular carton 90 is depicted, other configurations, such as cylindrical, might be used as well. The preferred material for the carton 90 is paperboard, but other suitable material may be used for all or a portion of the invention. The carton may be used to contain various material, ranging from food items to powdered or granular soap. The carton may bear indicia, graphics or printing, and it may be overwrapped with appropriate material.

It is contemplated that various changes, including those mentioned above, can be made without deviating from the spirit of the present invention. It is therefore desired that the foregoing description be considered as illustrative, not restrictive, and that reference be made to the appended claims to indicate the scope of the invention.

What is claimed is:

1. A carton having a pouring spout, said carton comprising:

a carton body having at least one double thickness wall area comprising an inside wall area and an outside wall area;

a divided external pouring spout component formed in and hingedly connected to said outside wall area, said component defining a dispensing opening having a top and a bottom;

an internal pouring spout component formed in said inside wall area and being movable through said dispensing opening from a closed to an open position and comprising:

a center part having a base and a pair of sides and being hingedly connected at said base to said inside wall area and superimposed by at least a portion of said external pouring spout component, and a first wing hingedly attached to and extending from one of said center part sides and a second wing hingedly attached to and extending from the other of said center part sides, said first wing defining one side of said pouring spout, said second being relatively smaller than said first wing, said second wing underlying at least a portion of said external pouring spout component; and means securing said external pouring spout component to said center part to form said pouring spout.

2. A reclosable pouring spout for integration and use with dispensing cartons having walls including at least one double thickness wall area comprising an inside wall area and an outside area, said spout comprising:

an external pouring spout component formed in an hingedly connected to the outside wall area, said component being split into at least two portions and defining a dispensing opening having a top and a bottom;

an interior pouring spout component formed in the inside wall area and being movable through said dispensing opening from a closed to an open position and comprising:

a center part having a base and two sides and being hingedly connected at the base to the inside wall area and superimposed by at least a portion of said external pouring spout component, and a first wing hingedly attached to and extending from one of said center part sides and a second attached to and extending from the other of said center sides said first wing defining one side of said pouring spout, said second wing being relatively smaller than said first wing, said second wing underlying at least a portion of said external pouring spout component, said first and second wings and said external pouring spout component providing said reclosable pouring spout with said walls from the top to the bottom of said dispensing opening; and means securing said external pouring spout component to said center part to form said reclosable pouring spout.

3. The carton according to claim 2, wherein said external spout component is split by a cut line.

4. A carton having an integral pouring spout comprising:

first and second side wall panels each having two parallel side edges;

a first end wall panel between and hingedly connected to said side wall panels along one of said side edges of each side wall panel;

a second end wall panel hingedly connected to the remaining side edge of said first side wall panel;

top and bottom closure flaps hingedly connected to said side and end wall panels;

a glue flap hingedly connected to the remaining side edge of said second side wall panel, said glue flap being secured to said second end wall panel, whereby said side and end walls form a body wall of a tubular carton body;

an external pouring spout component formed in and movably, hingedly connected to said second end wall panel, said component defining a dispensing opening having a top and a bottom;

an internal pouring spout component formed in said glue flap, said internal pouring spout component being movable through said dispensing opening in said second end wall panel from a closed to an open position and comprising:

a generally rectangular center part having a base and two sides and being hingedly connected at said base to said glue flap and located immediately under and superimposed by at least a portion of said external pouring spout component, and a first wing hingedly attached to and extending from one of said center part sides and a second wing hingedly attached to and extending from the other of said center part sides, said first wing having an outer edge comprising an unbroken arc and being so dimensioned as to completely close one side of said dispensing opening, said second wing being generally quadrilateral and relatively smaller than said first wing, said second wing underlying at least a portion of said external pouring spout component; and means securing said external pouring spout component to said center part to form said integral pouring spout, whereby said external pouring spout component and said first and second wings provide said integral pouring spout with side walls from the top to the bottom of said dispensing opening.

5. The carton according to claim 4, wherein an access tab is located above and immediately adjacent to said external pouring spout component, said access tab being removably attached to said second wall panel and to said external pouring spout component to prevent said integral pouring spout from being opened until said access tab is removed.

6. A foldable one-piece blank for forming a carton having an integral pouring spout formed therein, said blank comprising:

generally rectangular first and second side wall panels each having two parallel side edges;

a first end wall panel between and hingedly connecting said side wall panels along one of said two parallel side edges of each side wall panel;

a second end wall panel hingedly connected to the remaining edge of said first side wall panel;

top and bottom closure flap panels hingedly connected to said side and end wall panels;

a glue flap hingedly connected to the remaining edge of said second side wall panel, said glue flap being designed to be secured to said second end wall panel when said blank is folded to form a body wall of a tubular carton body;

an external pouring spout component formed in and movably attached to said second end wall panel, said component defining a dispensing opening having a top and a bottom and being hingedly connected to said second end wall panel;

a pouring spout formed in said glue flap, said spout being movable through said dispensing opening in said second end wall panel from a closed to an open position when said carton blank is folded to form the carton body, said spout comprising:

a generally rectangular center part having a base and two sides, said center part being hingedly connected at the base to said glue flap and designed to be located immediately under and superimposed by at least a portion of said external pouring spout component when said blank is folded to form the carton body, and a wing hingedly attached and extending to each side of said center part, one of said wings having an outer edge comprising an unbroken arc and being so dimensioned as to completely close one side of said dispensing opening when said blank is folded to form a carton body, the second of said wings being generally quadrilateral and relatively smaller than the other wing, said second wing being designed to underlie at least a portion of said external pouring spout component, whereby, when said blank is folded to form a carton, said wings and said external pouring spout component provide said pouring spout with side walls from the top to the bottom of said dispensing opening.

7. A carton having a pouring spout, said carton comprising:

a carton body having at least one double thickness wall area comprising an inside wall area and an outside wall area;

an external pouring spout component formed in and hingedly connected to said outside wall area and including a tab and a side wing, said tab being hinged to said outside wall area along a first axis and said side wing being hinged to said outside wall area along a second axis, said component defining a dispensing opening having a top and a bottom;

an internal pouring spout component formed in said inside wall area and being movable through said dispensing opening from a closed to an open position and comprising:

a center part having a base and a pair of sides and being hingedly connected at said base to said inside wall area and superimposed by at least a portion of said external pouring spout component, and a first wing hingedly attached to and extending from one of said center part sides and a second wing hingedly attached to and extending from the other of said center part sides, said first wing defining one side of said pouring spout, said second wing being relatively smaller than said first wing and underlying at least a portion of said external pouring spout component; and means securing said external pouring spout component to said center part to form said pouring spout.

8. The carton according to claim 1, wherein said tab and said side wing are immediately adjacent to each other.

9. The carton according to claim 1, wherein said tab is generally rectangular and said side wing is generally triangular.

10. The carton according to claim 9, wherein said dispensing opening includes a pair of sides and one of said first and second wings is so dimensioned as to extend along one side of said dispensing opening sides during movement of said pouring spout between said closed and open positions.

11. A reclosable pouring spout for integration and use with dispensing cartons having walls including at least one double thickness wall area comprising an inside wall area and an outside wall area, said spout comprising:

an external pouring spout component formed in and hingedly connected to the outside wall area, said component being split by a cut line to include a tab hingedly connected to said outside wall area and a side wing hingedly connected to said outside wall area, said component defining a dispensing opening having a top and a bottom;

an interior pouring spout component formed in the inside wall area and being movable through said dispensing opening from a closed to an open position and comprising:

a center part having a base and two sides and being hingedly connected at the base to the inside wall area and superimposed by at least a portion of said external pouring spout component, and a first wing hingedly attached to and extending from one of said center part sides and a second wing hingedly attached to and extending from the other of said center part sides, said first wing defining one side of said reclosable pouring spout, said second wing being relatively smaller than said first wing and underlying at least a portion of said external pouring spout component, said first and second wings and said external pouring spout component providing said reclosable pouring spout with side walls from the top to the bottom of said dispensing opening; and means securing said external pouring spout component to said center part to form said reclosable pouring spout.

12. A carton having an integral pouring spout comprising:

first and second side wall panels each having two parallel side edges;

a first end wall panel between and hingedly connected to said side wall panels along one of said edges of each side wall panel;

a second end wall panel hingedly connected to the remaining side edge of said first side wall panel;

top and bottom closure flaps hingedly connected to said side and end wall panels;

a glue flap hingedly connected to the remaining side edge of said second side wall panel, said glue flap being secured to said second end wall panel, whereby said side and end walls form a body wall of a tubular carton body;

an external pouring spout component formed in and movably, hingedly connected to said second end wall panel adjacent the upper end of said second end wall panel, said component defining a dispensing opening having a top and a bottom, being hingedly connected to said second end wall panel and being split by a cut line to include a generally rectangular pouring spout tab hingedly connected to said second end wall panel and a generally triangular supplemental wing hingedly connected to said second end wall panel;

an internal pouring spout component formed in said glue flap, said internal pouring spout component being movable through said dispensing opening in said second end wall panel from a closed to an open position and comprising:

a generally rectangular center part having a base and two sides and being hingedly connected at said base to said glue flap and located immediately under and superimposed by at least a portion of said external pouring spout component, and a first wing hingedly attached to and extending from one of said center part sides and a second wing hingedly attached to and extending from the other of said center part sides, said first wing having an outer edge comprising an unbroken arc and being so dimensioned as to completely close one side of said dispensing opening, said second wing being generally quadrilateral and relatively smaller than said first wing, said second wing underlying at least a portion of said external pouring spout component; and means securing said external pouring spout component to said center part to form said integral pouring spout, whereby said external pouring spout component and said first and second wings provide said integral pouring spout with side walls from the top to the bottom of said dispensing opening.

13. The carton according to claim 12 wherein said center part is under and substantially aligned with said pouring spout tab.

14. A foldable one-piece blank for forming a carton having an integral pouring spout formed therein, said blank comprising:

generally rectangular first and second side wall panels each having two parallel side edges;

a first end wall panel between and hingedly connecting said side wall panels along one of said two parallel side edges of each side wall panel;

a second end wall panel hingedly connected to the remaining edge of said first side wall panel;

top and bottom closure flap panels hingedly connected to said side and end wall panels;

a glue flap hingedly connected to the remaining edge of said second side wall panel, said glue flap being designed to be secured to said second end wall panel when said blank is folded to form a body wall of a tubular carton body;

an external pouring spout component formed in and hingedly, movably attached to said second end wall panel, said component including a tab and a side wing and defining a dispensing opening having a top and a bottom;

a pouring spout formed in said glue flap, said spout being movable through said dispensing opening from a closed to an open position after said carton blank is folded to form the carton body, said spout comprising:

a generally rectangular center part having a base and two sides, said center part being hingedly connected at the base to said glue flap and designed to be located immediately under and superimposed by at least a portion of said external pouring spout component when said blank is folded to form the carton body, and a wing hingedly attached to and extending from each side of said center part, one of said wings having an outer edge comprising an unbroken arc and being so dimensioned as to completely close one side of said dispensing opening when said blank is folded to form a carton body, the second of said wings being generally quadrilateral and relatively smaller than the other wing, said second wing being designed to underlie at least a portion of said external pouring spout component, whereby, when said blank is folded to form a carton, said wings and said external pouring spout component provide said pouring spout with side walls from the top to the bottom of said dispensing opening.

15. The blank according to claim 14 wherein said tab of said external pouring spout component is hingedly connected to said second end wall panel along a first axis and said side wing of said external pouring spout component is hingedly connected to said second end wall panel along a second axis.

16. The blank according to claim 15, wherein an access tab is located above and immediately adjacent to said external pouring component tab, said access tab being removably attached to said second end wall panel and to said external pouring spout component to prevent opening of said integral pouring spout until said access tab is removed.

* * * * *

UNITED STATES PATENT AND TRADEMARK OFFICE

CERTIFICATE OF CORRECTION

PATENT NO. : 5,215,250

DATED : June 1, 1993

INVENTOR(S) : Roccaforte, Harry I.

It is certified that error appears in the above-indentified patent and that said Letters Patent is hereby corrected as shown below:

In column 1, line 12, delete "pouring structures" and insert --pouring spout structures--.

In column 2, line 62, delete "paparboard" and insert --paperboard--.

In column 3, line 22, delete "glue flap" and insert --glue flap 14--.

In column 3, line 40, delete "extend 90°" and insert --extend beyond 90°--.

In column 3, line 63, delete "side wall" and insert --second side wall--.

In column 4, line 9, delete "ring" and insert --wing--.

In column 4, line 18, delete "spout tab" and insert --spout tab 64--.

In column 6, line 41, delete "second being" and insert --second wing being--.

In column 6, line 49, delete "outside area" and insert --outside wall area--.

In column 6, line 50, delete "an" (second occurrence) and insert --a--.

In column 6, line 64, delete "second attached" and insert --second wing hingedly attached--.

UNITED STATES PATENT AND TRADEMARK OFFICE

CERTIFICATE OF CORRECTION

PATENT NO. : 5,215,250

DATED : June 1, 1993

INVENTOR(S) : Roccaforte, Harry I.

It is certified that error appears in the above-indentified patent and that said Letters Patent is hereby corrected as shown below:

In column 6, line 66, delete "sides said" and insert --center part sides, said--.

In column 7, line 6, delete "with said" and insert --with side--.

In column 9, line 14, delete "claim 1" and insert --claim 7--.

In column 9, line 17, delete "claim 1" and insert --claim 7--.

In column 9, line 23, delete "one side of said" and insert --one of said--.

In column 9, line 68, delete "of said" and insert --of said side--.

Signed and Sealed this

Twelfth Day of July, 1994

Bruce Lehman

*Attest:*

BRUCE LEHMAN

*Attesting Officer*

*Commissioner of Patents and Trademarks*